United States Patent [19]

Eriksson et al.

[11] 4,219,792

[45] Aug. 26, 1980

[54] DEVICE FOR THE PRESTRESSING OF CONCENTRIC CYLINDERS

[75] Inventors: Kent Eriksson; Uno Zetterlund, both of Ludvika, Sweden

[73] Assignee: Asea AB, Vesteras, Sweden

[21] Appl. No.: 950,678

[22] Filed: Oct. 12, 1978

[30] Foreign Application Priority Data

Oct. 13, 1977 [SE] Sweden ..... 7711513

[51] Int. Cl.[2] ..... H01F 27/08; H01F 27/30

[52] U.S. Cl. ..... 336/60; 138/148; 336/197

[58] Field of Search ..... 336/197, 196, 210, 60; 174/70 R, 47; 138/111-114, 148, 149

[56] References Cited

U.S. PATENT DOCUMENTS

| | | | |
|---|---|---|---|
| 1,915,352 | 6/1933 | Bottoms | 138/111 X |
| 3,164,666 | 1/1965 | Camilli | 336/60 X |
| 3,646,972 | 3/1972 | Kuypers | 174/47 X |
| 3,775,842 | 12/1973 | Sheldon et al. | 336/60 X |

FOREIGN PATENT DOCUMENTS

| | | | |
|---|---|---|---|
| 1216956 | 5/1966 | Fed. Rep. of Germany | 174/70 R |
| 1477876 | 3/1967 | France | 336/60 |

*Primary Examiner*—Thomas J. Kozma

*Attorney, Agent, or Firm*—Watson, Cole, Grindle & Watson

[57] ABSTRACT

A device for effecting mechanical prestressing in a pair of substantially concentric cylinders, in which the inner cylinder is prestressed in compression and the outer cylinder is prestressed in tension by means of the device in the form of a hose or hoses disposed in a gap between the cylinders and being subjected internally to a pressure medium, the hose or hoses being arranged helically in such a manner that the sum of the moments of the forces thereby caused by the pressure forces between the cylinders and occurring about the central axis of the cylinders in a plane containing such axis, is substantially zero.

3 Claims, 3 Drawing Figures

DEVICE FOR THE PRESTRESSING OF CONCENTRIC CYLINDERS

BACKGROUND OF THE INVENTION

This invention relates generally to a means for effecting mechanical prestressing in a pair of substantially concentric cylinders.

The provision of short-circuit proof tape windings for electrical transformers presents considerable problems when the windings are formed as annular cylinders. The cylinders must be glued together between each joint thereof in order to make the cylinders rigid. If this is insufficient the cylinders must be supported against the core legs of the yoke of the transformer. Such supports normally comprise vertical laths disposed between the core legs and the inner winding, or between inner and outer windings when two windings are used. It nevertheless becomes difficult to render such windings shortcircuit proof. During the occurrence of a short-circuit, the inner winding is pressed radially inwardly toward the core leg. However, the radial shrinkage thus arising results in a bulging of the winding cylinder at some location of its circumference, so that the conductors may break and the distance to the adjacent winding cylinder may be reduced thereby risking the occurrence of a flash-over between windings.

British Pat. No 1,184,208 discloses an arrangement for supporting a transformer winding about a core leg. Hoses of plastic, for example, are disposed at some of the inner corners of the core leg which are so defined because the core leg is built-up of packets of laminations having different widths. These hoses are arranged axially of the leg and, after the winding has been assembled over the core leg, the hoses are filled under pressure with a thermosetting agent which is thereafter cured. These hoses therefore form axially disposed supporting surfaces for the winding and are radially spaced predetermined distances apart. Thus, the winding is unsupported between these supporting surfaces so that in the event of a short-circuit, the winding between such supports may become broken inwardly and may therefore be damaged.

It is known in rotary electrical machines to stay or support winding and coil ends by means of hoses which, after assembly, are filled with a thermosetting plastic material under high pressure. If this technique is applied to effect the prestressing of transformer windings, the hose or hoses must be wound helically between the inner winding and the core. A turn of the hose will then make contact with the core leg and with the winding cylinder at different elevations around each turn. Filling of the hose with material under high pressure will therefore result in an overturning moment of forces on the winding cylinder at the ends of the winding. This moment of forces presses the winding cylinder inwardly toward the core at one side and at one end of the winding, whereas at the other end of the winding the winding cylinder is pressed inwardly toward the core leg at the opposite side. It is assumed that the winding is wound a number of whole turns around the core leg.

SUMMARY OF THE INVENTION

In order to make it possible to utilize the known method of pressure medium filled hoses as a pressure device to achieve an efficient prestressing in two concentric cylinders, measures must be taken to avoid the aforementioned overturning moment of forces on the cylinders. Such a problem has been solved according to the present invention by arranging the pressure device so that the sum of the moments caused by the pressure forces between the cylinders and occurring about the central axis of the cylinders in a plane containing such axis, is substantially zero.

DETAILED DESCRIPTION OF THE INVENTION

Figure 1:
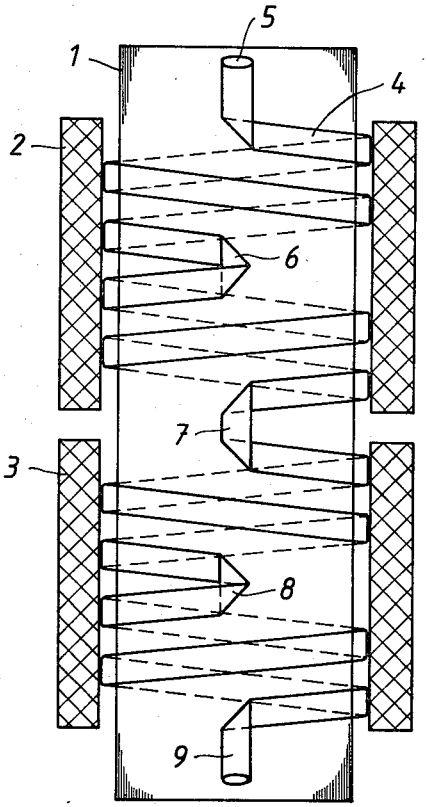
FIG. 1 is a side elevational view of a core leg for an electrical transformer and a section taken through two winding portions arranged co-axially.

Turning now to the drawings wherein like reference characters refer to like and corresponding parts throughout the several views, the invention will be described with reference to the prestressing in two concentric cylinders as applied to an electrical transformer. In such an arrangement, a core leg constitutes the inner cylinder and the innermost winding constitutes the outer cylinder.

Figure 2:
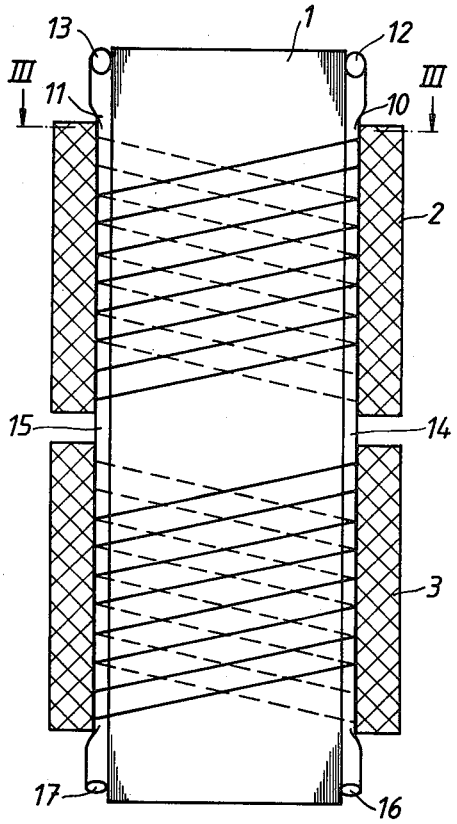
FIG. 2 is a view similar to FIG. 1 showing a variant according to the present invention.

In FIG. 1 and 2, windings 2 and 3 are arranged coaxially about a core leg 1. A pressure exerting device is disposed between the core leg and the outer windings for exerting an outwardly directed prestressing force on winding cylinders 2 and 3 for preventing the windings from being compressed radially should a short-circuit occur. The windings are assumed to be tape layer windings, i.e., layer windings in which the conductor comprises thein, wide tapes perferably of aluminum. The conductor tapers and the intermediate insulation of plastic or paper are glued together so that the winding is rendered rigid in an axial direction. A pressure exerting device comprising a hose 4 is wound about the core before the windings are assembled in place. This hose may be reinforced with diagonally spun glass fibers, and is provided with a sealing sheath of silicone rubber, or it may be reinforced with cross-spun polyester and have a sealing sheath of polyurethane rubber. The hose may otherwise be made in some alternatively appropriate manner so long as it is tight and can withstand high pressures. In order to avoid the aforementioned overturning moment of forces, hose 4 is wound from its inlet end 5 a number of whole turns around the core, which in the embodiment shown is two turns. Thereafter, the direction of winding the hose is reversed by folding it over on itself as at 6, and an equally large number of turns are wound in the opposite direction. After again folding the hose on itself as at 7, it is wound about the lower portion of the core so as to form a pressure exerting device for winding 3, the hose being similarly wound a number of whole turns in one direction after which it is folded on itself as at 8 and then wound in the opposite direction through its outlet 9.

It can therefore be seen that, when hose 4 is internally pressurized by means of a suitable medium under pressure, the hose will effectively apply compressive stress to the inner cylinder and tensile stress to the outer cylinder. The pressure to which the hose is internally subjected is of a sufficiently high magnitude as to withstand any shortcircuit forces that may occur from the windings. Also, it can be seen that the press forces on outer cylinders 2,3, as applied by the internally pressurized hose, and the moments of the forces occurring about the central axis will cancel out one another, thus preventing any overturning of the outer cylinders as the result of unequal moments of forces.

Although the hose has been described in FIG. 1 as being wound a plurality of whole turns before it is folded as at 6, such is not absolutely necessary. However, if the hose is not wound a number of whole turns, the press device will apply greater pressure about only a part of the circumference thereby resulting in a lateral displacement of cylinders 2,3 relative to one another so that they will no longer be co-axial. Such may therefore be avoided by winding the hose a number of whole turns about inner cylinder 1 between inlet 5 and fold 6 between folds 6,7, and 7,8 and between fold 8 and outlet 9. Thus, with the hose wound a number of whole turns at a small pitch, any lateral displacement of cylinders 2 and 3 is minimized.

FIG. 2 discloses a modification of the press device of FIG. 1 and includes a pair of hoses 10 and 11 respectively having inlets 12 and 13. The inlets are positioned diametrically opposite one another relative to inner cylinder 1, and the hoses are wound in the same direction about the inner cylinder but continuously diametrically opposite each other at each of the turns of the hoses. When hoses 10 and 11 are wound about the inner cylinder between opposite ends of outer cylinder 2, they are disposed axially at their transitional areas 14 and 15 before being similarly wound about the inner cylinder between opposite ends of outer cylinder 3 after which they respectively terminate in outlets 16 and 17. With such an arrangement, it can be seen that the radial and outwardly directed compressive forces produced by the pressurized hose 10 at each position is counteracted by radial and outwardly directed compressive forces asserted by pressurized hose 11. Accordingly, the occurrence of any overturning moments of forces exerted by the hoses and occurring about the central axis of the cylinders in a plane containing such axis, is substantially avoided. The two hoses are connected in parallel at the time they are filled with the pressure medium so that the same pressure is produced internally for both hoses and the same amount of molding compound is applied to both hoses.

Figure 3:
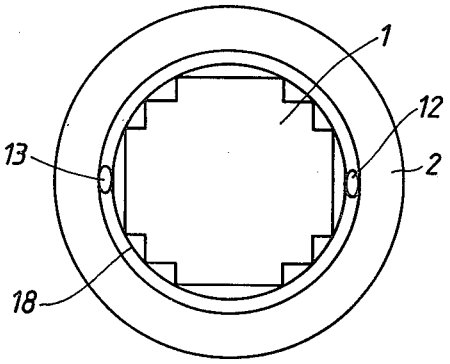
FIG. 3 is a sectional view taken substantially along line III—III of FIG. 2.

In FIG. 3 it can be seen that a cylinder 18 is suitably arranged about core leg 1 so that hoses 10 and 11 will more evenly contact the corners of the core leg. Such an arrangement is also typical for the FIG. 1 embodiment.

Although not shown, it is possible to utilize more that two hoses helically wound about inner cylinder 1 in parallel relationship between opposite ends of outer cylinder 2 and between opposite ends of outer cylinder 3, without departing from the invention. If three hoses are used, for example, they are radially spaced apart at the inlet and outlet ends respecting the outer cylinders by an angle equal to 360° divided by the number of hoses, i.e., by an angle of 120°, so as to provide an even distribution of the compressive forces on the windings.

The pressurized compound used for internally pressurizing the hoses may typically be a cast compound which cures or hardens after a predetermined time. During such time the compressive force is maintained so as to compensate for any volumetric changes. And, since the hoses are helically wound in slightly spaced parallel relationship, helicoidal oil channels will form between them do that oil may flow upwardly from the bottom of the transformer.

Although the invention has been described with reference to electrical transformers and their windings, it should be pointed out that the invention is likewise applicable for other technical areas as well, in which cylindrical bodies are to be prestressed by means of pressure hoses without generating overturning moments of forces.

Obviously, many other modifications and variations of the present invention are made possible in the light of the above teachings. It is therefore to be understood that within the scope of the appended claims the invention may be practiced otherwise than as specifically described.

We claim:

1. In an arrangement wherein inner and outer cylinders are disposed substantially concentric relative to one another, one of the cylinders being an electrical coil and the outer cylinder having an inner diameter greater than the outer diameter of the inner cylinder so as to define an annular gap between the cylinders, hose means disposed in the gap between the cylinders and being subjected internally to a pressure medium permanently applying compressive stress to the inner cylinder and tensile stress to the outer cylinder, characterized in that said hose means comprises at least one elongated hose helically wound about the inner cylinder between opposite ends of the outer cylinder, said hose being wound with an even number of turns, one-half the number of said turns being wound in one direction and the other half of the number of said turns being wound in a direction opposite said one direction, whereby the sum of the moments of the forces exerted by said hose between the cylinders and occurring about the central axis of the cylinders in a plane containing said axis, is substantially zero.

2. In an arrangement wherein inner and outer cylinders are disposed substantially concentric relative to one another, one of the cylinders being an electrical coil and the outer cylinder having an inner diameter greater than the outer diameter of the inner cylinder so as to define an annular gap between the cylinders, hose means disposed in the gap between the cylinders and being subjected internally to a pressure medium permanently applying compressive stress to the inner cylinder and tensile stress to the outer cylinder, characterized in that said hose means comprises a plurality of hoses helically wound in parallel relationship about the inner cylinder between opposite ends of the outer cylinder, said hoses being wound in one direction and having opposite ends respectively spaced apart radially by an angle equal to 360° divided by the number of said hoses, whereby the sum of the moments of the forces exerted by said hoses between the cylinders and occurring about the central axis of the cylinders in a plane containing said axis, is substantially zero.

3. In the arrangement according to claim 2, wherein two of said hoses are provided and are arranged diametrically opposite one another around the inner cylinder.

* * * * *